US005447272A

United States Patent [19]

Ask

[11] Patent Number: 5,447,272

[45] Date of Patent: Sep. 5, 1995

[54] AUTOMATIC DEICER SPREADER

[76] Inventor: Bernard J. Ask, 573 Pleasant Pl., Island Lake, Ill. 60042

[21] Appl. No.: 199,781

[22] Filed: Feb. 22, 1994

[51] Int. Cl.[6] ..... B05B 12/02

[52] U.S. Cl. ..... 239/7; 239/69; 239/71; 239/669; 239/687

[58] Field of Search ..... 137/79, 80, 624.12, 137/624.13, 565; 239/71, 70, 69, 668, 302, 669, 654, 650, 681, 687, 72

[56] References Cited

U.S. PATENT DOCUMENTS

| | | | |
|---|---|---|---|
| 3,201,006 | 8/1965 | Bernhardt . | |
| 4,209,131 | 6/1980 | Barash et al. | 239/60 X |
| 4,852,802 | 8/1989 | Iggulden et al. | 239/69 X |
| 4,895,303 | 1/1990 | Freyvogel | 239/69 X |
| 5,021,939 | 6/1991 | Pulgiese | 239/69 X |
| 5,060,859 | 1/1991 | Bancroft | 239/70 X |
| 5,148,826 | 9/1992 | Bakhashaei | 137/80 |
| 5,287,888 | 2/1994 | Geiger | 239/70 X |

*Primary Examiner*—Andres Kashnikow
*Assistant Examiner*—Kevin Weldon
*Attorney, Agent, or Firm*—James Creighton Wray

[57] ABSTRACT

A device for spreading a deicing agent onto any surface either autonomously, manually or by remote control. Upon detecting the onset of icing conditions, the device delivers either a granular or liquid deicing agent unto the targeted surface, preventing ice build up. The key components of the device include the deicing agent storage container ,the freezing sensor, the moisture detection sensor, timing circuits, power supply, motor, pump or impeller and switching system circuitry. The device also possesses the capability to log and or transmit data to a central site and can activate various warning signals. The device is contained within a corrosion, weather and vandal resistant housing and is powered by either line current with a battery backup or by battery power alone. The system is designed to require low maintenance and of rugged construction to endure harsh environmental exposure.

20 Claims, 2 Drawing Sheets

AUTOMATIC DEICER SPREADER

BACKGROUND OF THE INVENTION

1) Field of the Invention

The present invention relates to a machine that detects freezing conditions and spreads deicing material to the surface. More specifically, this device will automatically apply any deicing agent or traction improving agent to the targeted surface in wet and/or freezing conditions.

2) Prior Art

The application of a deicing compound to macks, bridges, sidewalks and roofs is a well established practice and devices used for said applications currently exist. Several of these patents are for Truck mourned sprayers of Salt, others are for the spreader machinery itself, like Bernhard Frederick A (N/A) U.S. Pat. No. 3,201,006 describing the endless chain delivery system of a salt spreader. No device is known, however, for providing for icing protection by an unattended, automatically activated deicing compound spreader.

SUMMARY OF THE INVENTION

The principle objective of the present invention is to provide a device that will detect the existence of icing conditions and apply a deicing compound, such as salt, potassium chloride, sand etc., to the targeted surface.

It is also the objective of the present invention to be easily maintained and left in a state of preparedness for use in icing conditions.

Another objective is to provide such a device in a size suited to its application, i.e., a large device for use on bridges and overpasses etc., a smaller device for use on parking garage ramps, driveways etc. and a still smaller device for residential walkways and flat surface deicing.

The primary benefit of attaining each of the above stated objectives is a greatly increased margin of safety for the users of the roads, bridges, parking lots and walkways. By providing for the unattended distribution of a deicing agent the safety of the user is not dependent upon a schedule of inspection or manpower deployment as required by manned salt spreaders.

DETAILED DESCRIPTION

Figure 1:
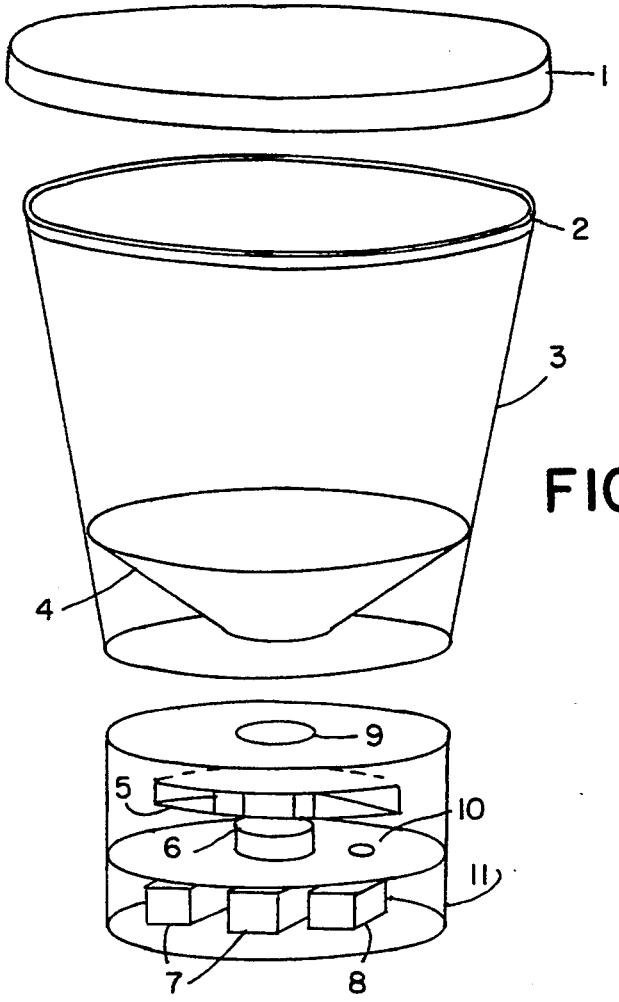
FIG. 1 is a fragmentary perspective view in accordance with the present invention.
Figure 2:
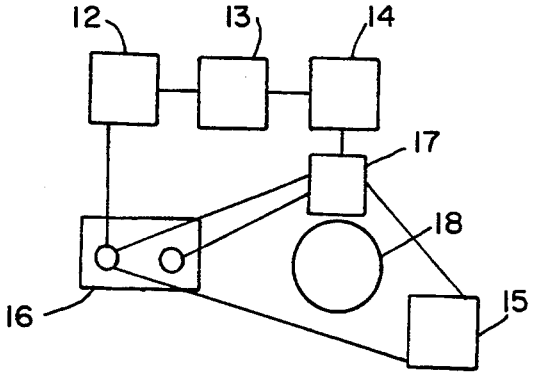
FIG. 2 is a schematic of the control process of said device.
Figure 3:
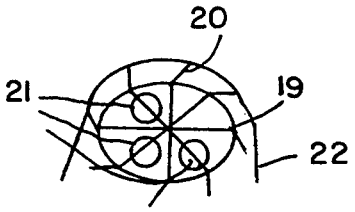
FIG. 3 is a top perspective of a central portion of the present invention.
Figure 4:
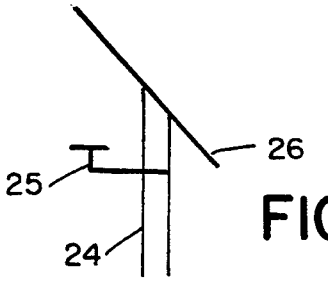
FIG. 4 is a side perspective of a component of the present invention.
Figure 5:
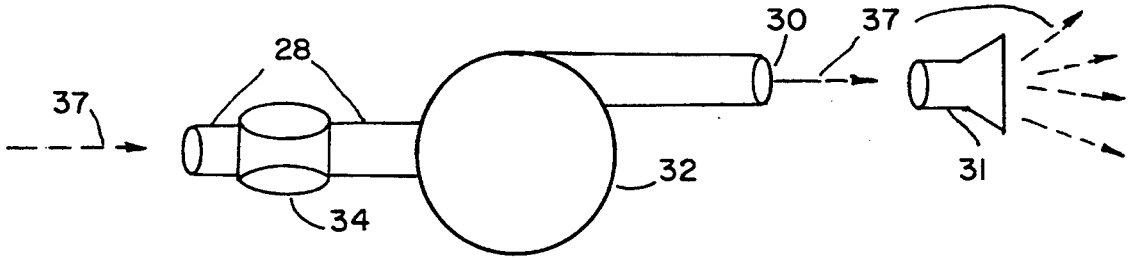
FIG. 5 is a schematic of a component of the present invention.
Figure 6:
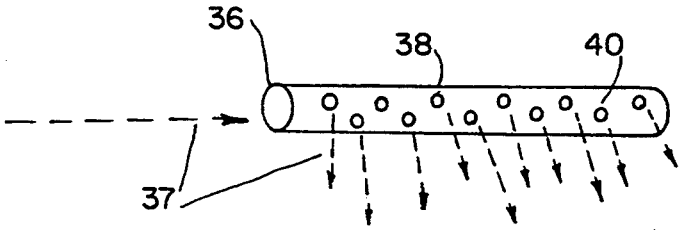
FIG. 6 is a perspective drawing of a component of the present invention.

As shown in the drawings, the preferred deicer spreading machine, in accordance with the present invention includes a locking, weatherproof cap 1 preferably made of a strong molded plastic material. The cap protects the deicing agent from the elements, theft and vandalism. The cap, or lid is secured to an integral molded reinforced ring 2 that provides rigidity to the deicing agent storage container 3. The container is a weatherproof and corrosion resistant material that can store bulk deicing agent for use by the present invention and is sized in accordance with the application and volume of deicing agent required. Within the drum is a molded plastic conical funnel 4 that directs the deicing agent via the hole 9 at the top of the base unit 11 onto the deicing agent spreading impeller 19 via the ports 21 in the top of the impeller housing 5. The deicing agent is kept in contact with the impeller by the impeller shroud 22 which acts as the outer boundary of the deicing agents' travel, allowing it to exit only from the slot in the impeller housing 5. The impeller blades each end with a flexible brush 20 that captures any small granular deicing agent and ejects it with rest of the deicing agent. These brushes also serve to keep the walls of the impeller shroud 22 clear of dust and debris. The twelve volt motor 6 that drives the impeller and spreads the deicing agent is seen schematic in FIG. 2 and consists of the motor 18, the temperature sensing switch 12, the moisture detection switch 13, the timer mechanism 14 and the remote control receiver and switching circuitry 15. In operation the motor 18 is activated when the temperature 12, moisture 13 and time delay 14 mechanisms reach the prescribed values, switching the electrical current to the motor relay 17 turning the motor for a predetermined time, and triggering the time delay mechanism 14 preventing further activation for a preset period of time. The controller circuitry contained in the control box 8 switches on the power to the motor via wires that pass from the battery 16 terminal posts through the motor relay 17 to the motor through the wire harness access hole 10. (For clarity the wiring harness is not illustrated.) In the configuration of the device which uses a liquid deicing agent said impeller mechanism is replaced by a pump 32 the liquid flow 37 to which is controlled by an electrical solenoid 34 opening or closing the flow from the inlet tube 28. The pump forces the liquid out of the exit manifold 30 to the ejector nozzle 31 or to the perforated tube 38 entering from the inlet end 36, exiting via the small perforations 40 onto the targeted surface. The controller also contains a timer circuit which shuts the motor off after the preset volume of deicing agent has been distributed and causes a preset period of time to elapse before the machine can be recycled to eject deicing agent again. The moisture detection mechanism 13 is located in an elevated position 25 upon a pole 24 attached to either the deicing agent drum 3 or a nearby structure such as a bridge, guard rail etc. This allows said mechanism to remain unaffected by moisture splashed from the ground. In addition the controller contains a small radio receiver with circuitry based upon the pocket pager which would allow for the remote control of the deicing agent spreader and operates separately from the temperature, moisture and tinting mechanism, functioning as a remote override controller. In order to maintain the power within the batteries 7 which are connected in parallels the batteries are charged by a photo voltaic cell 26 mounted on a vertically inclined post 24 providing unimpeded exposure to the sun thereby allowing for a the current generated to return to the batteries via a wiring harness to effect a trickle recharge action. The present invention uses a temperature alarm switch 12 and the moisture detection switch 13 in series to detect imminent icing conditions thereby engaging the switches to activate the deicer spreader; or uses a radio controlled remote control signal to activate the deicer spreader; applying a deicing agent to the targeted surface thereby providing deicing protection. In addition, the present invention is housed in a weatherproof, corrosion and vandal resistant molded plastic container, with the deicing agent stored in sufficient quantity to minimize the need for refills during the season of greatest icing danger. The use of multiple deep cycle batteries with a photo voltaic recharger provides a long term power supply suitable for extended use.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A method of automatically applying a deicing agent to any surface, comprising the steps of activating an applying device by remote control or autonomously by using on-board sensors causing the release of the agent via ejection by propelling means for deicing agents from a device comprising a weather and corrosion proof storage container for bulk storage and delivery of deicing agents, with a locking weatherproof lid, a conical molded funnel guiding the deicing agent via an inlet manifold leading into said propelling means, powered by line current or batteries stored in the base of said device and recharged by use of a photo voltaic cell or line voltage, using a motor controlling circuit comprised of a motor relay, a timer, a temperature sensor and a moisture sensor and remote control receiver circuit, which start the motor causing the deicing agent to be distributed upon the targeted surface, after a predetermined time the timer stops the motor and resets said sensors to a condition of preparedness for the next triggering signal from either the said receiver or said sensors.

2. A deicing machine for preventing icing on any surface, comprising a weather and corrosion proof storage container for bulk storage and delivery of deicing material, with a locking weatherproof lid, a conical molded funnel guiding the deicing agent onto a motor driven propelling means, powered by line current or batteries stored in the base of the device and recharged by use of a photo voltaic cell, using a motor controlling circuit comprised of a motor relay, a timer, a temperature sensor, a moisture sensor, and remote control receiver circuit, which, when activated, causes the motor to rotate the impeller in an action causing the deicing agent to exit onto the targeted surface, and after a predetermined time said timer switching the motor relay off and resetting said sensors to a condition of preparedness for the next triggering signal from either said remote control receiver or sensors.

3. A deicing machine comprising a weather and corrosion proof storage container for bulk storage and delivery of liquid deicing agent, with a locking weatherproof lid, an inlet tube guiding the liquid deicing agent into a tube, the flow controlled by a solenoid valve, leading into a manifold for distribution by a motorized electric pump via tubes to a nozzle positioned in proximity to and aimed toward the targeted surface, said electric pump and said solenoid valve are powered by line current or batteries stored in the detachable base of the device and recharged by use of a photo voltaic cell or line current, an on-board sensor based controlling circuit further comprising a motor and solenoid relay, a timer, temperature detection circuitry, a moisture detection circuit, and remote control receiver circuit, which activate said solenoid valve and said pump thereby allowing the deicing agent to flow through the tube using either gravity or said electric pump causing the liquid deicing agent to be distributed to the targeted surface and, after a predetermined time, said timer mechanism closing the solenoid valve and switching the pump motor relay off, resetting the timing mechanism and said icing detection sensors to a condition of preparedness for the next triggering signal from a remote control receiver or on-board sensors.

4. A deicing machine as described in claim 3 wherein the liquid deicing agent is distributed by means of a perforated tube with the pattern and number of perforations dependent upon both the size or volume of the target surface and deicing agent physical properties, said perforated tube residing upon or adjacent to the targeted surface.

5. The method of detecting icing conditions by means of on board sensors as described in claim 1, further comprising transmitting the existence of icing conditions to a central location from a remote site comprising the steps of using input from said sensors and transmitting a signal using a predetermined frequency to a central site receiver and issuing an audible and or visual warning upon activation by input received from said sensors.

6. The method of providing notification of icing conditions to users of a surface targeted by a plurality of said devices as described in claim 1 comprising the steps of using a signal from said sensors, transmitting said signal to a local receiver and thereby activating a visual and or audible warning device.

7. A deicing agent sprayer as described in claim 3, wherein the deicing agent is a non-conductive deicing agent and wherein said applying device is installed by means for electrically isolating the device, rendering said device suitable for deicing electrical transmission devices comprising insulators, transformers, breaker bars, wiring, and grounding devices.

8. A deicing device as described in claim 2 further comprising means by which the level of deicing agent in the device is measured and a radio transmission device to transmit a signal to a remote receiver to warn of depleted level of deicing agent.

9. A deicing device as described in claim 3 further comprising means by which the level of deicing agent in the device is measured and a radio transmission device to transmit a signal to a remote receiver to warn of depleted level of deicing agent.

10. A deicing method as described in claim 1, further comprising connecting the applying device to pilot controlled runway lights for providing means for deicing runways, ramps and taxi ways at airports.

11. A deicing device as described in claim 3, further comprising booster pumps controlled by said controlling circuit for providing means for said applying device to provide deicing to a very large area or an area of great length by boosting the hydraulic pressure to said liquid distribution outlets.

12. A deicing device as described in claim 2, further comprising means for linking numerous devices to provide coverage over a greater area or an area of greater length by causing multiple deicing devices to simultaneously spread deicing agent.

13. A deicing device as described in claim 2, further comprising limit means for allowing operation of said device only during predetermined hours.

14. A deicing device as described in claim 3, further comprising limit means for allowing operation of said device only during predetermined hours.

15. A deicing device as described in claim 2, further comprising means for manual operation of said device.

16. A deicing device as described in claim 3, further comprising means for manual operation of said device.

17. A deicing device as described in claim 2, further comprising a data logger for long term measurement and recording of conditions at the deicing device location.

18. A deicing device as described in claim 3, further comprising a data logger for long term measurement and recording of conditions at the deicing device location.

19. A deicing device as described in claim 2, further comprising an alarm with means for transmitting a warning signal to a remote site in the event of any failure in the deicing device operation.

20. A deicing device as described in claim 3, further comprising an alarm with means for transmitting a warning signal to a remote site in the event of any failure in the deicing device operation.

* * * * *